US012070063B2

(12) United States Patent
Liu

(10) Patent No.: US 12,070,063 B2
(45) Date of Patent: Aug. 27, 2024

(54) SMOKING DEVICE CARTRIDGE AND SUPPORT MEMBER

(71) Applicant: Future Technology Co., Ltd., Izumi (JP)

(72) Inventor: Kaipeng Liu, Izumi (JP)

(73) Assignee: Future Technology Co., Ltd., Izumi (JP)

( * ) Notice: Subject to any disclaimer, the term of this patent is extended or adjusted under 35 U.S.C. 154(b) by 0 days.

(21) Appl. No.: 18/395,624

(22) Filed: Dec. 25, 2023

(65) Prior Publication Data

US 2024/0122242 A1 Apr. 18, 2024

Related U.S. Application Data

(63) Continuation of application No. PCT/JP2023/020596, filed on Jun. 2, 2023.

(30) Foreign Application Priority Data

Jun. 6, 2022 (JP) ..... 2022-091362

(51) Int. Cl.
*A24F 40/42* (2020.01)
*A24F 40/465* (2020.01)
*A24F 40/485* (2020.01)

(52) U.S. Cl.
CPC ..... *A24F 40/42* (2020.01); *A24F 40/465* (2020.01); *A24F 40/485* (2020.01)

(58) Field of Classification Search
None
See application file for complete search history.

(56) References Cited

U.S. PATENT DOCUMENTS

2019/0075845 A1 3/2019 Malgat et al.
2020/0245679 A1* 8/2020 Watanabe ..... A24F 40/20
(Continued)

FOREIGN PATENT DOCUMENTS

JP 2019-512235 A 5/2019
JP 6950118 B 10/2021
(Continued)

OTHER PUBLICATIONS

International Search Report for PCT/JP2023/020596dated Jul. 11, 2023.
PCT written opinion dated Jul. 11, 2023.

*Primary Examiner* — Dionne W. Mayes
(74) *Attorney, Agent, or Firm* — Yokoi & Co., U.S.A.; Toshiyuki Yokoi

(57) ABSTRACT

A smoking device cartridge 10 is mounted in an induction heating type smoking device for use. The smoking device cartridge 10 includes an aerosol-forming substrate 12 having a predetermined extending direction and a predetermined circumferential direction, the aerosol-forming substrate 12 containing tobacco or non-tobacco plants as raw materials; a susceptor 13 located along the extending direction in the aerosol-forming substrate 12, the susceptor 13 being configured to be inductively heatable; a packaging member 16 covering the aerosol-forming substrate 12 along the circumferential direction; and a first support member 11 being in contact with the packaging member 16, the first support member 11 supporting one end of the aerosol-forming substrate 12 in the extending direction, the aerosol-forming substrate 12 including the susceptor 13 in the aerosol-forming substrate 12. The smoking device cartridge 10 has a gap G between the first support member 11 and the packaging member 16.

10 Claims, 13 Drawing Sheets

(56) References Cited

U.S. PATENT DOCUMENTS

| | | | | |
|---|---|---|---|---|
| 2021/0112855 | A1 | 4/2021 | Watanabe | |
| 2024/0023600 | A1* | 1/2024 | Kawasaki et al. ..... | A24D 1/20 |

FOREIGN PATENT DOCUMENTS

| | | | |
|---|---|---|---|
| WO | 2019/220904 | A | 11/2019 |
| WO | 2021/124494 | A | 6/2021 |

* cited by examiner

SMOKING DEVICE CARTRIDGE AND SUPPORT MEMBER

CROSS-REFERENCES TO RELATED APPLICATIONS

This application claims the benefit of priority and is a Continuation application of the prior International Patent Application No. PCT/JP2023/020596, with an international filing date of Jun. 2, 2023, which designated the United States, and is related to the Japanese Patent Application No. 2022-091362, filed Jun. 6, 2022, the entire disclosures of all applications are expressly incorporated by reference in their entirety herein.

BACKGROUND OF THE INVENTION

1. Field of the Invention

The present invention relates to a smoking device cartridge and a support member.

2. Description of Related Art

In recent years, various tobacco products have become popular. Among these tobacco products, so-called heating type tobacco products can be heated without using flame by mounting a cartridge containing tobacco ingredients in a heating type smoking device. Smokers can inhale the tobacco components vaporized by heating and enjoy the tobacco. Cartridges containing plant components other than tobacco are also becoming popular.

As to heating type smoking devices, for example, smoking devices including a heating element and smoking devices including an induction heating element are known. In the smoking device including the heating element, the heating element has, for example, a blade shape, a rod shape, a pin shape, or a triangular shape, and the heating element is inserted into a cartridge including an aerosol-forming substrate. In the smoking device including the induction heating element, a cartridge having a susceptor in the aerosol-forming substrate is used (e.g., Patent Document 1). By the susceptor being inductively heated, the aerosol-forming substrate is heated and aerosol is generated.

[Patent Document 1] WO2017/153443

BRIEF SUMMARY OF THE INVENTION

In cartridges used for such induction heating type smoking devices, it is desirable to ensure a gas flow path in the cartridge while supporting the susceptor and the aerosol-forming substrate.

The present invention provides a smoking device cartridge and a support member capable of ensuring a gas flow path in the cartridge while supporting a susceptor and an aerosol-forming substrate, in view of the above circumstances.

The present invention provides a smoking device cartridge to be mounted in an induction heating type smoking device for use. The smoking device cartridge includes an aerosol-forming substrate having a predetermined extending direction and a predetermined circumferential direction, the aerosol-forming substrate containing tobacco or non-tobacco plants as raw materials; a susceptor located along the extending direction in the aerosol-forming substrate, the susceptor being configured to be inductively heatable; a packaging member covering the aerosol-forming substrate along the circumferential direction; and a first support member being in contact with the packaging member, the first support member supporting one end of the aerosol-forming substrate in the extending direction, the aerosol-forming substrate including the susceptor in the aerosol-forming substrate. The smoking device cartridge has a gap between the first support member and the packaging member.

Furthermore, the present invention for achieving the above object provides a support member in a smoking device cartridge to be mounted in an induction heating type smoking device for use, the smoking device cartridge including an aerosol-forming substrate having a predetermined extending direction and a predetermined circumferential direction, the aerosol-forming substrate containing tobacco or non-tobacco plants as raw materials; a susceptor located along the extending direction in the aerosol-forming substrate, the susceptor being configured to be inductively heatable; and a packaging member covering the aerosol-forming substrate along the circumferential direction, the support member supporting one end of the aerosol-forming substrate in the extending direction, the aerosol-forming substrate including the susceptor in the aerosol-forming substrate. The support member includes a facing portion facing the susceptor; and a contact portion outside the facing portion, the contact portion being in contact with the packaging member. A gap is located between the support member and the packaging member.

According to the present invention, since the support member (first support member) is located in the smoking device cartridge and the support member, one end of the aerosol-forming substrate including the susceptor therein is supported. Furthermore, since a gap is located between the support member and the packaging member covering the aerosol-forming substrate along the circumferential direction, gas flows through the gap. Consequently, it is possible to ensure the gas flow path in the cartridge while supporting the susceptor and the aerosol-forming substrate.

DETAILED DESCRIPTION OF THE INVENTION

Figure 1A:
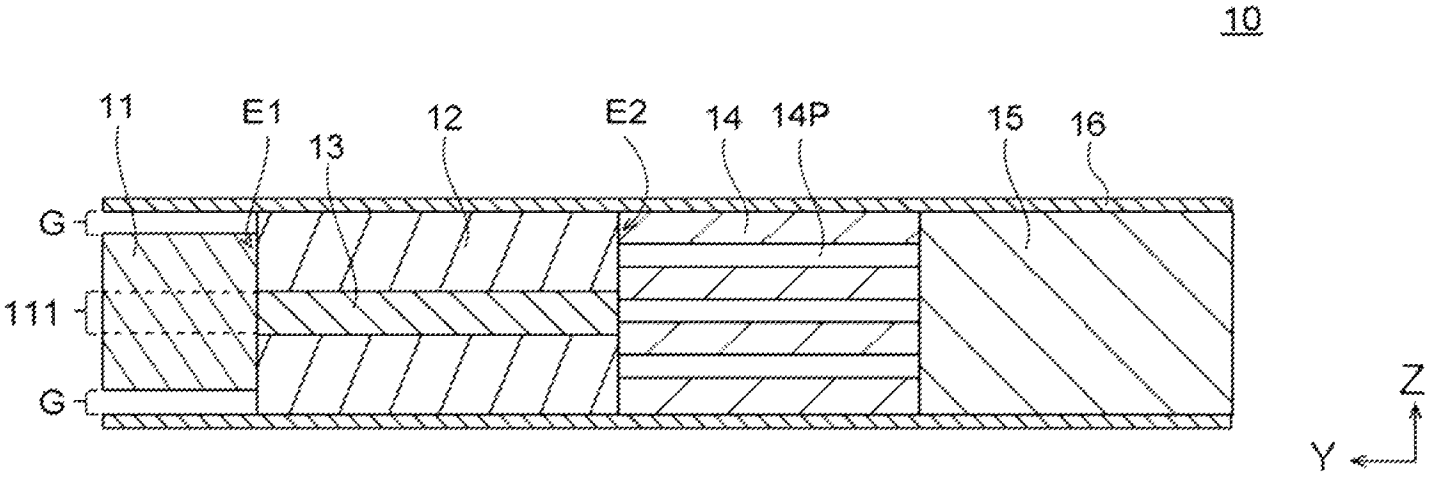
FIG. 1A is a cross-sectional view showing a configuration of a smoking device cartridge according to one embodiment of the present invention.

The following embodiments of the present invention will be described with reference to the drawings. In the drawings, the same reference letters are used for the same components. The dimensional ratios in the drawings are exaggerated for the sake of explanation and may differ from the actual ratios.

Embodiment

Figure 1B:
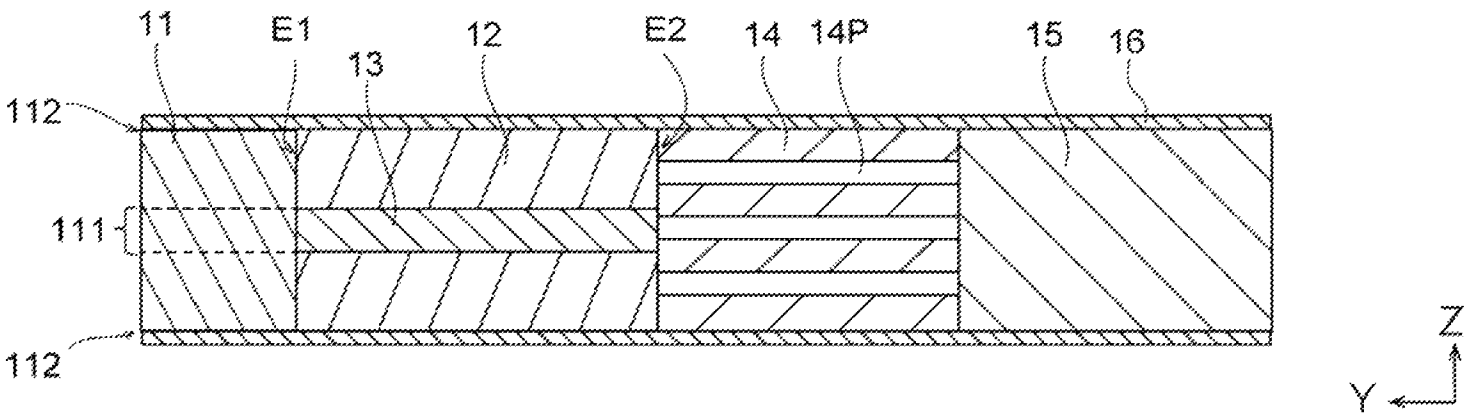
FIG. 1B is a cross-sectional view at a position different from that of the cross-sectional view shown in FIG. 1A.
Figure 2:
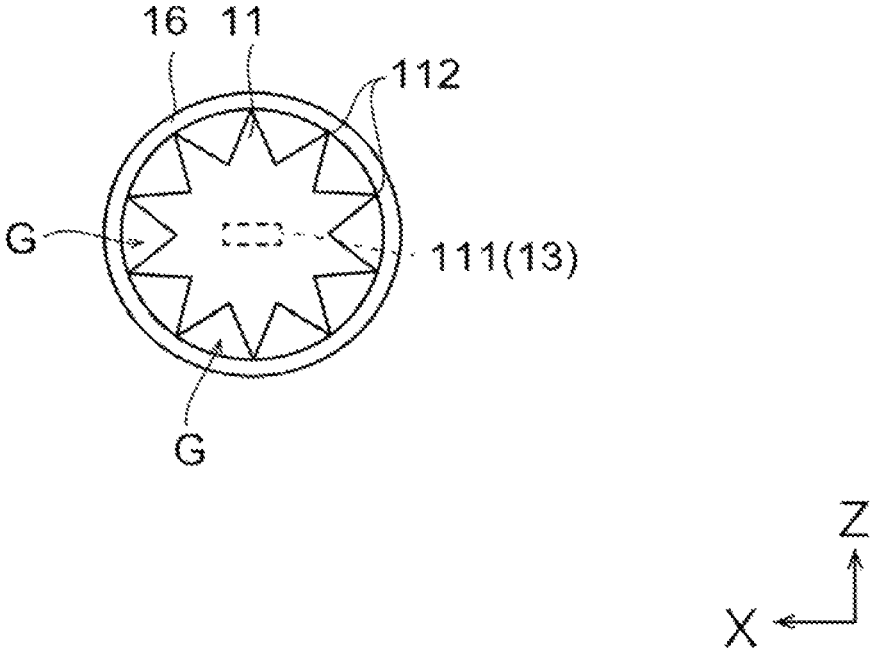
FIG. 2 is a plan view showing an example of a configuration of one end portion of the smoking device cartridge shown in FIGS. 1A and 1B.

FIGS. 1A, 1B and 2 show the configuration of a smoking device cartridge (smoking device cartridge 10) according to one embodiment of the present invention. The smoking device cartridge 10 has, for example, a cylindrical shape and extends in a predetermined direction. FIGS. 1A and 1B are sectional views showing the configuration of the smoking device cartridge 10 in the extending direction, and FIG. 2 is a plan view showing the configuration of one end (on a side of a first support member 11 to be described later) in the extending direction. In the following description, the extending direction of the smoking device cartridge 10 may also be referred to as a Y direction, and the width direction and the height direction may be referred to as an X direction and a Z direction, respectively. FIGS. 1A and 1B are YZ cross-sectional views of the smoking device cartridge, and FIG. 2 is an XZ plan view. FIGS. 1A and 1B show the YZ cross sections at different positions.

<Configuration of Smoking Device Cartridge 10>

The smoking device cartridge 10 includes, for example, a first support member 11, an aerosol-forming substrate 12, a susceptor 13, a second support member 14, a mouthpiece 15, and a packaging member 16. The susceptor 13 is located within the aerosol-forming substrate 12. In the smoking device cartridge 10, in the Y-direction, the first support member 11, the aerosol-forming substrate 12 including the susceptor 13, the second support member 14, and the mouthpiece 15 are located in this order. The packaging member 16 is located along the extending direction (Y-direction) of the smoking device cartridge 10, and the area from the first support member 11 to the mouthpiece 15 is covered with the packaging member 16.

The aerosol-forming substrate 12 is located between the first support member 11 and the second support member 14, and lies along the Y direction. The aerosol-forming substrate 12 is, for example, formed in a cylindrical shape, and has one end E1 and the other end E2 in the Y direction. The one end E1 of the aerosol-forming substrate 12 is, for example, in contact with the first support member 11, and the other end E2 of the aerosol-forming substrate 12 is, for example, in contact with the second support member 14.

The aerosol-forming substrate 12 contains tobacco plants or non-tobacco plants as raw materials. Examples of the tobacco plants include tobacco leaves, tobacco stems, expanded tobacco, homogenized tobacco, and the like. The non-tobacco plants refer to plants other than the tobacco plants. The aerosol-forming substrate 12 preferably includes parts of the non-tobacco plants such as leaves, fruit pulp, seeds, roots (scale roots, tuberous roots, etc.), stems, tubers, barks (stem barks, tree barks, etc.), flowers (petals, stamens, pistils, etc.), trunks, branches, or the like.

Herein, "plants" refer to a biological classification contrasting with animals. The plants as used herein include not only organisms that have roots and live in fixed locations, such as grass and trees, but also algae such as microalgae and seaweed, fungi such as mushrooms, and the like.

The aerosol forming material 12 is a powdered or granulated aggregate obtained by, for example, appropriately mixing an aerosol former to generate aerosols, microcrystalline cellulose, flavoring additives, preservatives, and binders or thickeners with dried and ground non-tobacco plants, and then grinding or classifying the mixture. The aerosol-forming substrate 12 may be in a paste form. Alternatively, the aerosol-forming substrate 12 may be formed by forming raw materials containing the non-tobacco plants into a sheet and then cutting the sheet so as to have a predetermined width and length.

In the case that the part of the non-tobacco plants are leaves, tea can preferably be used as the aerosol-forming substrate 12. This is because tea includes various types of tea plants and it is possible to produce different teas even from the same plant through different processing methods. Specific examples thereof include, for example, Japanese tea, black tea, *Hydrangea macrophylla* tea, *Hydrangea macrophylla* tea, *Gynostemma pentaphyllum* tea, aloe tea, ginkgo leaf tea, oolong tea, turmeric tea, *Quercus salicina* tea, *Eleutherococcus senticosus* tea, *Plantago asiatica* tea, *Glechoma hederacea* tea, persimmon leaf tea, kamitsure tea, chamomile tea, *Kawara Ketsumei* tea, Chinese quince tea, chrysanthemum flower tea, gymnema tea, guava tea, Chinese wolfberry fruit tea, mulberry leaf tea, black soybean tea, *Geranium thunbergii* tea, brown rice tea, burdock tea, comfrey tea, kelp tea, cherry blossom tea, saffron tea, shiitake mushroom tea, perilla tea, Jasmine tea, ginger tea, *Equisetum arvense* tea, *Acorus gramineus* tea, *Swertia japonica* tea, *Fagopyrum esculentum* tea, *Aralia elata* tea, dandelion tea, sweet tea, *Houttuynia cordata* tea, *Eucommia ulmoides* tea, sword bean tea, elderberry tea, nezumimochi tea, adlay tea, senna tea, loquat leaf tea, pu'er tea, safflower tea, pine needle tea, mate tea, barley tea, *Acer maximowiczianum* tea, mugwort tea, eucalyptus tea, eucalyptus tea, *Siraitia grosvenorii* tea, bitter melon tea, and the like. The tea residues after drinking may be used as the aerosol-forming substrate 12. By using the tea residues or the like, it is possible to recycle and effectively utilize expensive teas, etc.

Furthermore, extracts, so-called essences, processed products, or the like, of the non-tobacco plants may be used for the aerosol-forming substrate 12. Examples of the form of the extracts include liquids, syrup-like substances, powders, granules, solutions, and the like. For example, the aerosol-forming substrate 12 can be formed by saturating any substrate such as a paper-like sheet capable of absorbing a solution with a solution or the like containing the extracts of the non-tobacco plants.

Examples of the aerosol former contained in the aerosol-forming substrate 12 include glycerin, propylene glycol, sorbitol, triethylene glycol, lactic acid, diacetin (glyceryl diacetate), triacetin (glyceryl triacetate), triethylene glycol diacetate, triethyl citrate, isopropyl myristate, methyl stearate, dimethyl dodecanedioate, dimethyl tetradecanedioate, and the like. Among these, glycerin and propylene glycol are preferable.

The microcrystalline cellulose contained in the aerosol-forming substrate 12 may, for example, be formed by first producing α-cellulose from fibrous plant pulp and then partially depolymerizing the α-cellulose with acid. In this microcrystalline cellulose, the soluble component is removed from the cellulose, and the insoluble component is crystallized. The microcrystalline cellulose may be in a form of a powder, or may be in a form of a suspension in which the microcrystalline cellulose is dispersed in a solvent such as water. For example, a high-speed stirrer or a high-pressure homogenizer can be used for the dispersion in the solvent.

It is preferable that the aerosol-forming substrate 12 contains a flavoring additive. Examples of the flavoring additives include extracts of peppermint, cocoa, coffee and black tea, powdered catechin of tea extract, and the like. It is preferable that the preservatives contained in the aerosol-forming substrate 12 is preservatives used in food, and examples of the preservatives include sorbic acid, potassium sorbate, benzoic acid, sodium benzoate, and the like.

The aerosol-forming substrate 12 may contain menthol and a water-insoluble cross-linked polymer (preferably polyvinylpolypyrrolidone). Combining menthol with a water-insoluble crosslinked polymer effectively prevents sublimation of the menthol, and allows the menthol flavor to be kept for a long period of time. The menthol herein includes not only those obtained from natural sources but also those synthesized. The aerosol-forming substrate 12 may contain peppermint, mint, peppermint oil, or other menthols.

The above flavoring additives may be provided in the mouthpiece 15. For example, the wall portion of the mouthpiece 15 may be impregnated with the flavoring additive, or a capsule in which the flavoring additive is encapsulated may be embedded in the wall portion of the mouthpiece 15. Alternatively, the capsule having the encapsulated flavoring additive may be positioned between the mouthpiece 15 and the aerosol-forming substrate 12. In the case that the flavoring additive is encapsulated in the capsule, the smoker pressing the capsule with his or her fingers causes the capsule to be broken, and causes the aromatic components of the flavoring additive to be volatilized. Consequently, smokers can generate the aromatic components at their preferred timing. The flavoring additive encapsulated in the capsule may be provided in the aerosol-forming substrate 12 or in the second support member 14.

Examples of the binders or the thickeners contained in the aerosol-forming substrate 12 include guar gum, xanthan gum, gum, cellulose binder, organic acid, salt of conjugate base of organic acid, polysaccharides, and combinations thereof. Examples of the gum include arabic gum, locust bean gum, and the like. Examples of the cellulosic binder include hydroxypropyl cellulose, carboxymethyl cellulose, hydroxyethyl cellulose, methyl cellulose, ethyl cellulose, and the like. Examples of the salt of conjugate base of organic acid include sodium alginate, sodium carboxymethyl cellulose, and the like. Examples of the polysaccharides include carrageenan, agar, pectin, and the like.

The susceptor 13 located within the aerosol-forming substrate 12 is, for example, a plate-like member having with a rectangular shape in the XY plane. The susceptor 13 is made of, for example, a single plate-like member. The susceptor 13 is located, for example, along the central axis of the aerosol-forming substrate 12, and is positioned at the central part of the aerosol-forming substrate 12 in the XZ plane. The size of the susceptor 13 in the Y direction (referred to as length hereinafter) is substantially the same as the size of the aerosol-forming substrate 12 in the Y direction, and the susceptor 13 is exposed on at least one end E1 of the aerosol-forming substrate 12. The susceptor 13 may be exposed at the other end E2 of the aerosol-forming substrate 12. The length of the susceptor 13 is, for example, 12 mm to 18 mm. The width (size in the X direction) of the susceptor 13 is, for example, 1.0 mm to 2.5 mm. The thickness (size in the Z direction) of the susceptor 13 is, for example, 0.11 mm to 0.63 mm.

The susceptor 13 is configured to be inductively heatable. The susceptor 13 is inserted into a smoking device (e.g., a smoking device 20 in FIG. 3, which will be described later), and is inductively heated by induced current flowing through the susceptor 13. This causes the aerosol-forming substrate 12 to be heated to a sufficient temperature, and generates aerosol.

The susceptor 13 is made of, for example, an alloy containing a plurality of magnetic metal materials. These magnetic metal materials have different Curie temperatures from each other. Examples of magnetic metal materials include ferromagnetic metal materials, paramagnetic metal materials, and diamagnetic metal materials. Ferromagnetic metal materials strongly exhibit magnetism in the same direction as an external magnetic field when the external magnetic field is applied and remains the strong magnetism even when the external magnetic field is reduced to zero, and examples of ferromagnetic metal materials include iron, nickel, cobalt, ferritic stainless steel, and the like. Relative magnetic permeability of ferromagnetic metal materials is much larger than 1, for example, the relative magnetic permeability of the iron is about 5000, the relative magnetic permeability of the nickel is about 600, the relative magnetic permeability of the cobalt is about 250, and the relative magnetic permeability of the ferritic stainless steel is about 1000 to 1800.

Paramagnetic metal materials weakly exhibit magnetism in the same direction as an external magnetic field when the external magnetic field is applied and loses the magnetism when the external magnetic field is reduced to zero, and examples of paramagnetic metal materials include aluminum, chromium, platinum, manganese, and the like. Relative magnetic permeability of paramagnetic metal materials is slightly larger than 1, for example, the relative magnetic permeability of the aluminum is about 1.000021, the relative magnetic permeability of the platinum is about 1.000265, and the relative magnetic permeability of the manganese is about 1.000830.

Diamagnetic metal materials weakly exhibit magnetism in the opposite direction to an external magnetic field when the external magnetic field is applied and loses the magnetism when the external magnetic field is reduced to zero, and examples of diamagnetic metal materials include copper, graphite, bismuth, and the like. Relative magnetic permeability of diamagnetic metal materials is slightly smaller than 1, for example, the relative magnetic permeability of the copper is about 0.999990, the relative magnetic permeability of the graphite is about 0.99980, and the relative magnetic permeability of the bismuth is about 0.999834.

When a ferromagnetic metal material is subjected to an alternating magnetic field, induced current flows to generate Joule heat, and heat (hysteresis loss) is generated due to friction and vibration between molecules. Hence, ferromagnetic metal materials are easily inductively heated compared to paramagnetic metal materials and diamagnetic metal materials. Consequently, it is preferable for the susceptor 13 to include a plurality of ferromagnetic metal materials having different Curie temperatures.

Furthermore, ferromagnetic metal materials have a high Curie temperature. For example, the Curie temperature of nickel is about 358 degree Celsius. For this reason, even if the smoking device cartridge 10 is heated to a high temperature of, for example, 200 degree Celsius, the susceptor 13 does not reach the Curie temperature, and holds the property of ferromagnetic material. As a result, the aerosol-forming substrate 12 can be stably heated. The susceptor 13 is made of, for example, an alloy containing nickel, chromium, aluminum, silicon, manganese, carbon, phosphorus, sulfur, iron, or the like. The susceptor 13 may be made of an alloy containing iron and nickel, or an alloy containing iron and cobalt.

The susceptor 13 may be made of an alloy containing a ferromagnetic metal material and a paramagnetic metal material, such as an alloy containing iron, chromium, and aluminum. The susceptor 13 may be made of an alloy containing a ferromagnetic metal material and a diamagnetic metal material, such as an alloy containing iron and copper.

The second support member 14, which is located between the aerosol-forming substrate 12 and the mouthpiece 15, supports the opposite end E2 of the aerosol-forming substrate 12 and serves to cool the aerosol generated from the aerosol-forming substrate 12. The second support member 14 is, for example, in contact with the other end E2 of the aerosol-forming substrate 12. The second support member 14 is, for example, formed in a cylindrical shape having a diameter substantially equal to that of the aerosol-forming substrate 12, and a peripheral surface of the second support member 14 is in contact with the packaging member 16. This causes the position of the second support member 14 to be fixed in the Y-axis direction. The peripheral surface of the second support member 14 may be adhered to the packaging member 16.

The second support member 14 has a flow path 14P extending in the Y-axis direction. The flow path 14P is formed as, for example, a through hole that penetrates the second support member 14 in the Y-axis direction. Gas passes in the Y-axis direction between the aerosol-forming substrate 12 and the mouthpiece 15 through the flow path 14P.

The second support member 14 is, for example, an assembly of a plurality of tubular members, each of the tubular members has a cavity, and the flow paths 14P are composed of the cavities of the cylindrical members. Namely, the second support member 14 has a plurality of the flow paths 14P. By constructing the second support member 14 using multiple tubular members, the surface area of the second support member 14 is increased to enhance its cooling function. The second support member 14 may be formed of one tubular member. The size of the second support member 14 may, for example, have an outer diameter of 4.0 mm to 7.5 mm and a length (along the central axis) in the Y direction of 50 mm or less. It should be noted that the second support member 14 may have a size and a shape different from those exemplified above, depending on its function, configuration, and the like.

It is preferable that the second support member 14 is made of a heat-resistant material. Examples of the heat-resistant material include a rubber-based material such as silicon rubber, and the like. For example, the second support member 14 can be formed of a plurality of tubular members obtained by rolling a silicon rubber sheet. Forming the second support member 14 out of the heat-resistant material can provide the second support member 14 adjacent to the aerosol-forming substrate 12. In addition to the rubber-based material, the second support member 14 may be made of a paper-based material, a resin-based material, a metal-based material, or the like, and may be made of a sheet thereof. Examples of the paper-based material include paper, cardboard, and the like. Examples of the resin-based material include polymer, and the like.

The second support member 14 may be formed by one cylindrical member, and the flow path 14P may be formed by providing a through hole in the cylindrical member. The cylindrical member as the second support member 14 may contain, for example, glass, ceramic, a heat-resistant resin material, or the like.

The mouthpiece 15 is provided in contact with the second support member 14, and is connected to the other end E2 of the aerosol-forming substrate 12 via the second support member 14. The mouthpiece 15 constitutes the other end portion of the smoking device cartridge 10 in the Y direction, i.e., the mouthpiece. The mouthpiece 15 is made of, for example, paper or the like. The mouthpiece 15 may include a filter for removing particulates, such as a cellulose acetate filter. The filter filters out part of particulates in water vapor and aerosol generated in the aerosol-forming substrate 12.

The first support member 11 faces the second support member 14 with the aerosol-forming substrate 12 sandwiched between the first support member 11 and the second support member 14. The first support member 11 supports the one end E1 of the aerosol-forming substrate 12 including the susceptor 13 in the aerosol-forming substrate 12. Since the first support member 11 supports the one end E1 of the aerosol-forming substrate 12 and the second support member 14 supports the other end E2 of the aerosol-forming substrate 12, the Y-directional position of the aerosol-forming substrate 12 and the susceptor 13 inside the aerosol-forming substrate 12 is maintained.

The first support member 11 is formed of, for example, a plate-like member having a planar shape of a star-shaped decagon (decagram) (FIG. 2). The first support member 11 includes, for example, a facing portion 111 facing the susceptor 13 and contact portions 112 outside the facing portion 111, the contact portions 112 being in contact with the packaging member 16. A gap G is located between the first support member 11 and the packaging member 16. FIG. 1B shows a YZ cross section at a position corresponding to the contact portion 112, and FIG. 1A shows a YZ section at a position corresponding to the gap G.

The facing portion 111 is located at a position facing the susceptor 13, or in other words, on an extension line of the susceptor 13. The facing portion 111 is, for example, located in the central part of the XZ plane. Since the susceptor 13 is covered with the facing portion 111, the susceptor 13 can be protected from the outside.

Each of the contact portions 112 is located at, for example, an apex of the first support member 11. The contact portion 112 may make point contact with the packaging member 16, or it may make surface contact with the packaging member 16. Each of the contact portions 112 may be adhered to the packaging member 16. Since the first support member 11 has the contact portion 112, the Y-directional position of the first support member 11 is fixed. It is possible to stabilize the Y-directional position of the first support member 11 more effectively by having multiple contact portions 112.

The gap G is located, for example, between adjacent contact portions 112. In the gap G, the first support member 11 is spaced apart from the packaging member 16, and the one end E1 of the aerosol-forming substrate 12 is exposed (FIG. 1B). The gap G ensures the gas flow path in the smoking device cartridge 10. Specifically, gas flows into the one end E1 of the aerosol-forming substrate 12 from the outside through the gap G, and is discharged from the one end E1 of the aerosol-forming substrate 12 to the outside of the smoking device cartridge 10. Since the smoking device cartridge 10 has a plurality of the gaps G, it is possible to perform the inflow and discharge of gas more efficiently.

The first support member 11, which has a shape that forms the gap G, for example, has a planer shape with irregularities provided, such as a star-shaped polygon (e.g. FIG. 2). Such a first support member 11 is easy to handle in a production process as compared with a shape without irregularities. Additionally, it reduces generation of static electricity. This can improve productivity.

The first support member 11 is made of a non-porous material, and preferably has heat resistance. Since the smoking device cartridge 10 has the gap G, even if the first support member 11 made of the non-porous material is used, the gas flow path is ensured. Non-porous materials are easier to mold and handle than porous materials. For this reason, using a non-porous material to form the first support member 11 allows for a greater degree of freedom in shaping. It is also possible to enhance the aesthetic appearance by placing marks or other decorative element on the first support member 11.

Examples of the heat-resistant non-porous material include a rubber-based material, a resin-based material, a metal-based material, a paper-based material, and the like. The first support member 11 includes at least one of these materials. Examples of the rubber-based material include silicone rubber, and the like. Examples of the resin-based material include polypropylene, polyethylene, acrylic, vinyl chloride, fluororesin, PET (Polyethyleneterephthalate), PTFE (polytetrafluoroethylene), and the like. Examples of the metal-based material include aluminum (Al), iron (Fe), brass (Cu—Zn), and the like. Examples of the paper-based material include compression-molded paper, cardboard, and the like.

It is preferable that the first support member 11 is attachable to and detachable from the smoking device cartridge 10. For example, it is possible to insert the smoking device cartridge 10 into a smoking device including a heating element after the first support member 11 is detached from the smoking device cartridge 10. The heating element is designed to be inserted into the aerosol-forming substrate 12 and heats it to generate aerosol. The heating element is made of a metal having a blade shape, a rod shape, a pin shape, a triangular shape, or a polygonal shape, for example. The heating element may have a cylindrical shape, a prismatic shape, a conical shape, a pyramidal shape, or other shape. Since the first support member 11 is attachable to and detachable from the smoking device cartridge 10, it is possible to use the smoking device cartridge for both the smoking device including the heating element and the smoking device including the induction heating element (e.g., a smoking device 20 in FIG. 3, which will be described later). In other words, a hybrid cartridge can be realized.

The packaging member 16 surrounds the first support member 11, the aerosol-forming substrate 12, the second support member 14, and the mouthpiece 15 along the circumferential direction (the circumferential direction of the aerosol-forming substrate 12). For example, the packaging member 16 can be formed by winding a sheet-like member such as paper along the circumferential direction of the first support member 11, the aerosol-forming substrate 12, the second support member 14, and the mouthpiece 15. The packaging member 16 may be formed of a plurality of the sheet-like members.

<Method of Using Smoking Device Cartridge 10>

Figure 3:
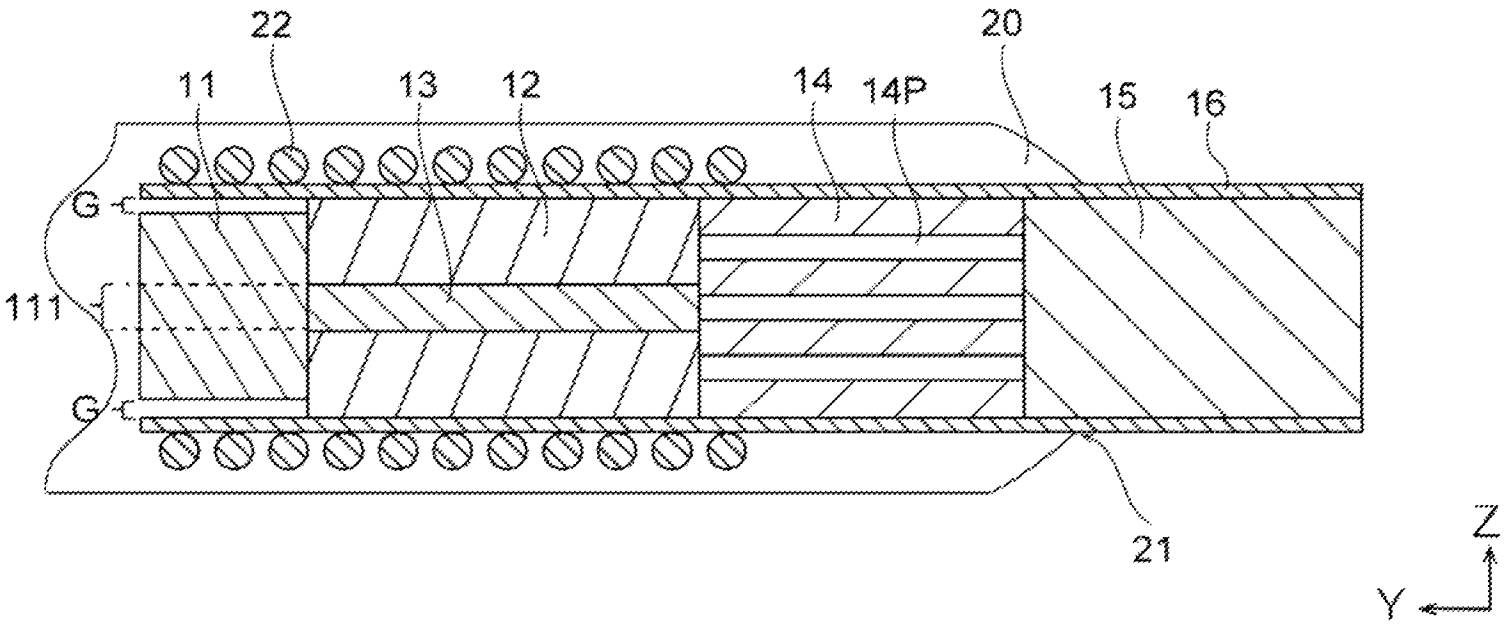
FIG. 3 is a cross-sectional view showing a state that the smoking device cartridge shown in FIGS. 1A and 1B is inserted into a smoking device.

FIG. 3 shows an example of a method of using the smoking device cartridge 10. The smoking device cartridge 10 is used by being mounted in the induction heating type smoking device 20. The smoking device 20 includes an insertion port 21, a coil 22, and a circuit board (not shown).

The insertion port 21 is a hole portion for inserting the smoking device cartridge into the smoking device 20, and is extended from the end portion of the smoking device 20 in a predetermined direction. The smoking device cartridge 10 is inserted into the smoking device 20 through the insertion port 21. The coil 22 surrounds the smoking device cartridge 10 inserted into the smoking device 20 along the circumferential direction. The circuit board includes a CPU configured to control supply of alternating current to the coil 22.

First, the smoker inserts the smoking device cartridge 10 into the insertion port 21, with the first support member 11 facing the insertion port 21. Since the first support member 11 has higher rigidity than the aerosol-forming substrate 12, the smoking device cartridge 10 is less likely to be broken as compared with a case where the first support member 11 is not provided. In addition, the smoker can more easily insert the smoking device cartridge 10 into the insertion port 21 of the smoking device 20.

After the smoker inserts the smoking device cartridge 10 into the insertion port 21 of the smoking device 20 and turns on the smoking device 20, the alternating current is supplied to the coil 22 by the circuit board. This causes induced current to flow through the susceptor 13 located in the aerosol-forming substrate 12, and Joule heat and heat due to hysteresis loss are generated in the susceptor 13. In other words, the susceptor 13 is inductively heated. The aerosol-forming substrate 12 surrounding the susceptor 13 is heated by the heat transferred from the inductively heated susceptor 13, and aerosol is generated.

When the smoker holds the mouthpiece 15 in his or her mouth and inhales, air flows into the one end E1 of the aerosol-forming substrate 12 from the outside of the smoking device cartridge 10 through the gap G between the packaging member 16 and the first support member 11. Due to this air inflow, the aerosol, which is generated by the aerosol-forming substrate 12, flows into the smoker's mouth via the flow path 14P of the second support member 14 and the mouthpiece 15. Since the smoking device cartridge 10 has the plurality of the gaps G, a plurality of the gas flow paths are formed. This allows the aerosol to efficiently flow into the smoker's mouth. Since a plurality of air flows mix and flow into the smoker's mouth, the smoker can obtain a stronger flavor and taste. Additionally, the reduced suction resistance allows the aerosol to flow into the smoker's mouth more smoothly.

Since efficient air convection occurs through the gap G of the smoking device cartridge 10, the heat generated by the susceptor 13 is dispersed, and it is possible to suppress excessive temperature increase inside the smoking device 20. This prevents the smoking device 20 from deteriorating, and allows its use for a longer period of time.

<Operation and Effect of First Support Member 11 and Smoking Device Cartridge 10>

Since the first support member 11 is located in the smoking device cartridge 10 according to the present embodiment, the one end E1 of the aerosol-forming substrate 12 including the susceptor 13 therein is supported. This enables the Y-directional position of the one end E1 of the aerosol-forming substrate 12 to be maintained at a predetermined position. Since the first support member 11 is provided, the one end E1 of the aerosol-forming substrate 12 is less exposed to the external environment, and for example, damage or the like of the aerosol-forming substrate 12 is prevented due to physical contact, chemical contact, or the like with the one end E1 of the aerosol-forming substrate 12. Furthermore, tea leaves and the like contained in the aerosol-forming substrate 12 are less likely to crumble from the one end E1 of the aerosol-forming substrate 12. Since the first support member 11 has the facing portion 111, it is possible to protect and support the susceptor 13 more effectively.

Furthermore, a gap G is located between the first support member 11 and the packaging member 16. This allows gas to flow into the one end E1 of the aerosol-forming substrate 12 from the outside through this gap G, and allows gas to be discharged from the one end E1 of the aerosol-forming substrate 12 to the outside. In other words, the gas flow path in the smoking device cartridge 10 is ensured. Hence, it is possible to ensure the gas flow path in the cartridge while supporting the susceptor 13 and the aerosol-forming substrate 12 in the smoking device cartridge 10 and the first support member 11.

Moreover, the other end E2 of the aerosol-forming substrate 12 is supported by the second support member 14 in the smoking device cartridge 10. In other words, since both ends (the one end E1 and the other end E2) of the aerosol-forming substrate 12 are supported by the first support member 11 and the second support member 14, it is possible to compress the aerosol-forming substrate 12. This enables the aerosol-forming substrate 12 to be stably held. In particular, in the case that the aerosol-forming substrate 12 contains granular material, the aerosol-forming substrate 12 is less likely to crumble and can be effectively held.

Hereinafter, modified examples of the smoking device cartridge described in the above embodiment will be described. In order to avoid duplication of description, detailed description of the same configurations as those of the smoking device cartridge described in the above embodiment will be omitted in the following.

Modified Example 1

Figure 4:
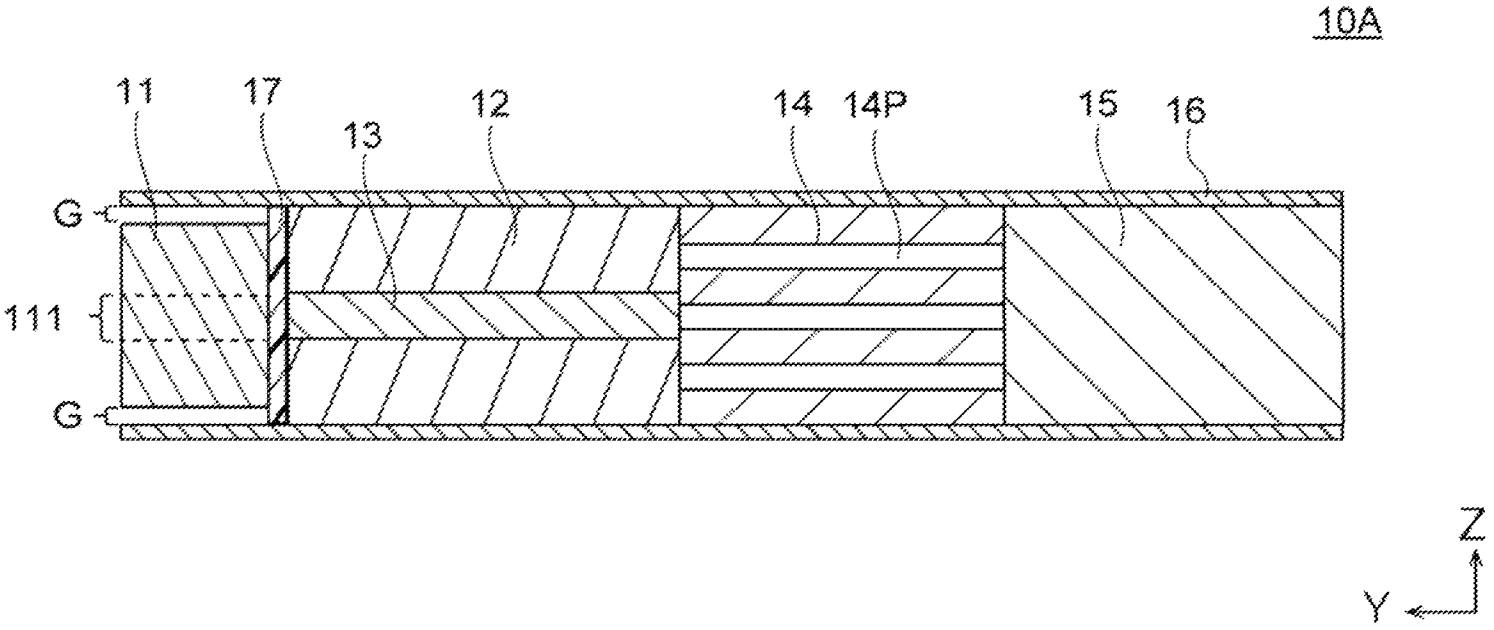
FIG. 4 is a cross-sectional view showing a configuration of a smoking device cartridge according to Modified Example 1.

FIG. 4 shows a cross-sectional (YZ cross-sectional) configuration of a smoking device cartridge (smoking device cartridge 10A) according to Modified Example 1. The smoking device cartridge 10A has a membrane member 17 between the one end E1 of an aerosol-forming substrate 12 and the first support member 11. In this respect, the smoking device cartridge 10A is different from the smoking device cartridge 10 (FIGS. 1A and 1B) according to the above embodiment. Except for this difference, the smoking device cartridge 10A according to Modified Example 1 has the same configuration as that of the smoking device cartridge 10 described in the above embodiment, and exhibits the same operations and effects.

The membrane member 17 is made of a porous material, a nonwoven fabric, or the like. Specifically, the membrane member 17 can be made of a metal-based material, a paper-based material, a resin-based material, a fiber-based material, a rubber-based material, or the like. Examples of the metal-based material include aluminum (Al), iron (Fe), brass (Cu—Zn), and the like. The examples of the metal-based material also include sintered metal, metal powder sintering, and the like. Examples of the paper-based material include paper, compression-molded paper, cardboard, and the like. Examples of the resin-based material include polypropylene, polyethylene, polyester, acrylic, vinyl chloride, fluororesin, PET, PTFE, and the like. Examples of the fibrous material include acetate (acetyl cellulose), diacetate, triacetate, polyester, and the like. Examples of the rubber-based material include silicon rubber and the like. The membrane member 17 may be made of glass, borosilicate glass, ceramic, quartz, or the like.

The membrane member 17 mentioned above prevents any leakage or similar issues of the constituent material of the aerosol-forming substrate 12 through the gap G, and can hold the aerosol-forming substrate 12 in place.

Modified Example 2

Figure 5:
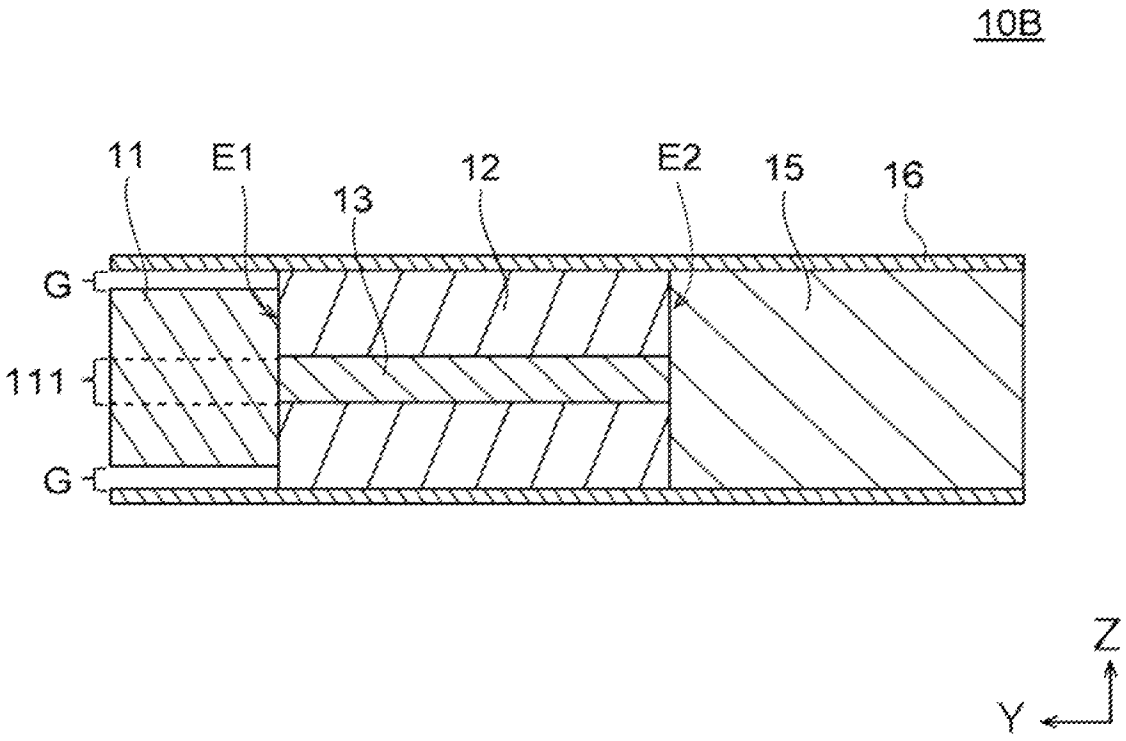
FIG. 5 is a cross-sectional view showing a configuration of a smoking device cartridge according to Modified Example 2.

FIG. 5 shows a cross-sectional (YZ cross-sectional) configuration of a smoking device cartridge (smoking device cartridge 10B) according to Modified Example 2. The smoking device cartridge 10B has the first support member 11, the aerosol-forming substrate 12 including the susceptor 13, and the mouthpiece 15 in this order in the Y direction, and the mouthpiece 15 is in contact with the other end E2 of the aerosol-forming substrate 12. That is to say, the smoking device cartridge 10B does not have the support member (the second support member 14 in FIG. 1). In this respect, the smoking device cartridge 10B is different from the smoking device cartridge 10 (FIGS. 1A and 1B) according to the above embodiment. Except for this difference, the smoking device cartridge 10B according to Modified Example 2 has the same configuration as that of the smoking device cartridge 10 described in the above embodiment, and exhibits the same operations and effects.

The aerosol-forming substrate 12 is supported by the packaging member 16 in the smoking device cartridge 10B. In other words, it is possible to omit the support member by using the packaging member 16 capable of supporting the aerosol-forming substrate 12. The smoking device cartridge 10B mentioned above without the support member reduces the number of the components and lower the cost.

Modified Example 3

Figure 6:
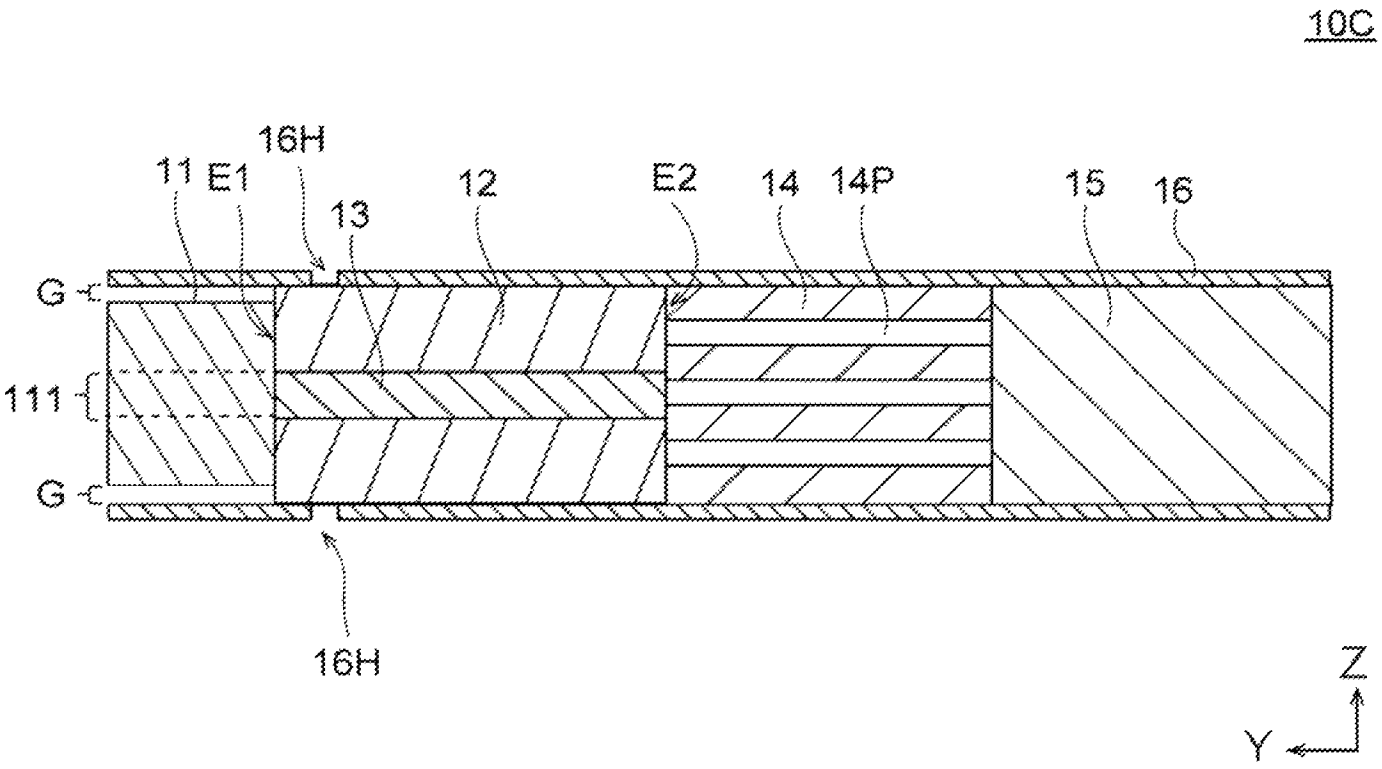
FIG. 6 is a cross-sectional view showing a configuration of a smoking device cartridge according to Modified Example 3.

FIG. 6 shows a cross-sectional (YZ cross-sectional) configuration of a smoking device cartridge (smoking device cartridge 10C) according to Modified Example 3. The smoking device cartridge 10C has hole portions 16H located in the packaging member 16. In this respect, the smoking device cartridge 10C is different from the smoking device cartridge 10 (FIGS. 1A and 1B) according to the above embodiment. Except for this difference, the smoking device cartridge 10C according to Modified Example 3 has the same configuration as that of the smoking device cartridge 10 described in the above embodiment, and exhibits the same operations and effects.

The hole portion 16H passes through the packaging member 16 in its thickness direction. The hole portion 16H reaches, for example, the aerosol-forming substrate 12. In other words, the hole portion 16H is made through the packaging member 16 surrounding the aerosol-forming substrate 12. The packaging member 16 may have a plurality of the hole portions 16H, or may have one hole portion 16H. The hole portion 16H functions as the gas flow path into the cartridge. Since the packaging member 16 surrounding the aerosol-forming substrate 12 has the hole portion 16H, it is possible to cause external air to flow into the aerosol-forming substrate 12 more efficiently. The hole portion 16H may be located at other locations such as the periphery of the second support member 14.

In the smoking device cartridge 10C, in addition to the gap G between the first support member 11 and the packaging member 16, the hole portion 16H of the packaging member 16 functions as the gas flow path into the cartridge. Specifically, air flowing in from the gap G flows along the axial direction (Y direction) of the aerosol-forming substrate 12, passes through the outer peripheral surface of the aerosol-forming substrate 12 from the hole portion 16H, and flows in inside the aerosol-forming substrate 12. Accordingly, the aerosol near the central axis of the aerosol-forming substrate 12, which is heated by the susceptor 13, and the aerosol on the outer peripheral side of the aerosol-forming substrate 12, which has a lower temperature, are mixed. Smokers, therefore, can obtain a stronger flavor and taste by using the smoking device cartridge 10C compared to the smoking device cartridge 10.

Modified Example 4

Figure 7:
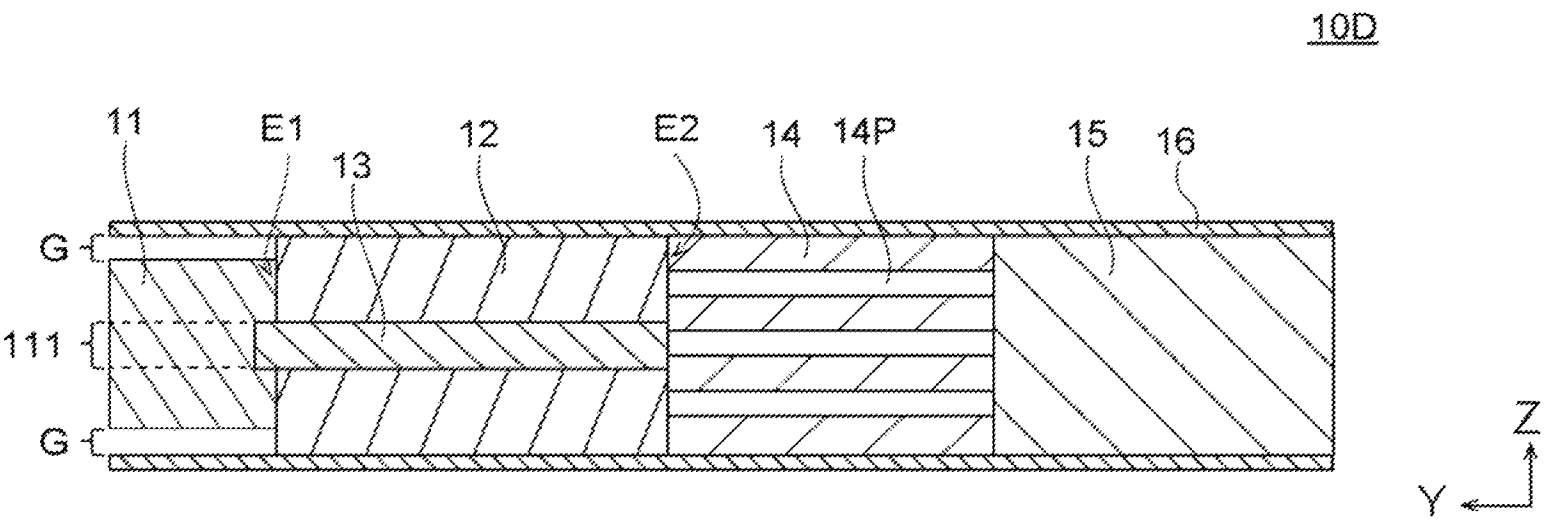
FIG. 7 is a cross-sectional view showing a configuration of a smoking device cartridge according to Modified Example 4.

FIG. 7 shows a cross-sectional (YZ cross-sectional) configuration of a smoking device cartridge (smoking device cartridge 10D) according to Modified Example 4. In the smoking device cartridge 10D, the susceptor 13 is fixed to the first support member 11. In this respect, the smoking device cartridge 10D is different from the smoking device cartridge 10 (FIGS. 1A and 1B) according to the above embodiment. Except for this difference, the smoking device cartridge 10D according to Modified Example 4 has the same configuration as that of the smoking device cartridge 10 described in the above embodiment, and exhibits the same operations and effects.

The susceptor 13 is, for example, inserted into an insertion hole on the first support member 11 and fixed to the first support member 11. The susceptor 13 may be inserted into and fixed to the first support member 11 by pressing the susceptor 13 against the first support member 11. Alternatively, the susceptor 13 may be fixed to the first support member 11 with an adhesive or the like.

In this smoking device cartridge 10D, when the first support member 11 is removed from the smoking device cartridge 10D, the susceptor 13 comes out of the aerosol-forming substrate 12 together with the first support member 11. This makes it easier to use the smoking device cartridge 10D with the smoking device including the heating element.

Modified Example 5

Figure 8:
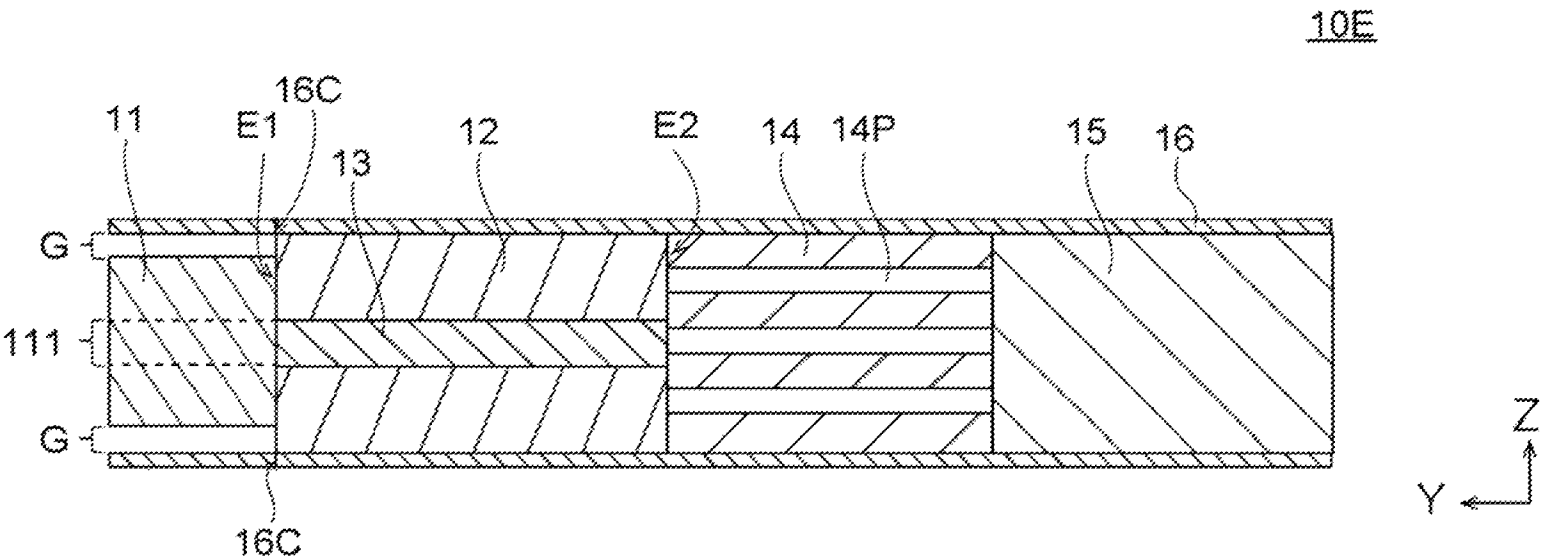
FIG. 8 is a cross-sectional view showing a configuration of a smoking device cartridge according to Modified Example 5.

FIG. 8 shows a cross-sectional (YZ cross-sectional) configuration of a smoking device cartridge (smoking device cartridge 10E) according to Modified Example 5. The smoking device cartridge 10E has an incision (incision 16C) located in the packaging member 16. In this respect, the smoking device cartridge 10E is different from the smoking device cartridge 10 (FIGS. 1A and 1B) according to the above embodiment. Except for this difference, the smoking device cartridge 10E according to Modified Example 5 has the same configuration as that of the smoking device cartridge 10 described in the above embodiment, and exhibits the same operations and effects.

The incision 16C, which is made on the packaging member 16, is located at a position within an area from the one end E1 of the aerosol-forming substrate 12 to the first support member 11. The incision 16C may be located at a position corresponding to the one end E1, or may be located at a position corresponding to the first support member 11. The incision 16C may extend over the circumference of the packaging member 16, or may be located in part of the circumference. The depth of the incision 16C should be such that it is broken when the smoker applies a light force.

When the smoker applies force to the incision 16C on the smoking device cartridge 10E, the packaging member 16 is broken and the first support member 11 is detached from the smoking device cartridge 10E. This makes it easier for the smoker to use the smoking device cartridge 10E with the smoking device including the heating element.

Other Modified Examples

The present invention is not limited to the above-described embodiment, and can be modified in various ways within the scope of the claims.

For example, the planar shape of the first support member 11 has been described as the star-shaped decagon (FIG. 2) in the above-described embodiment, however, the first support member 11 may have any other planar shape.

Figure 9A:
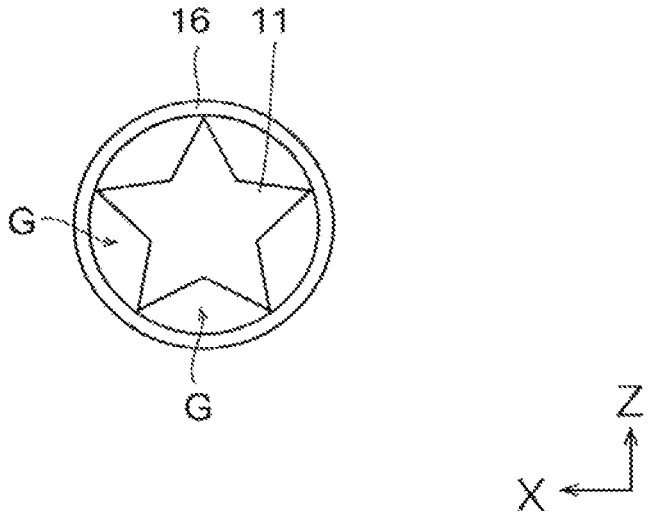
FIG. 9A is a plan view showing another example of the first support member shown in FIG. 2.
Figure 9B:
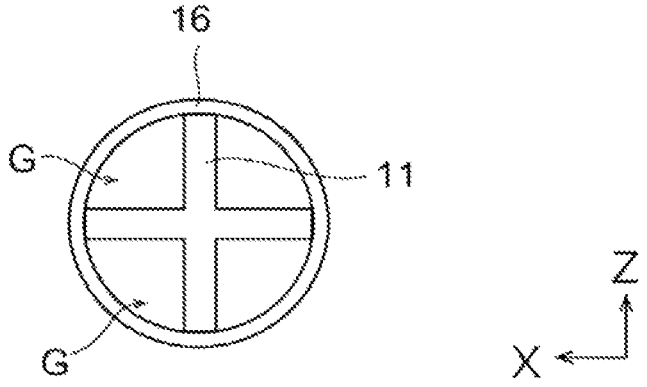
FIG. 9B is a plan view showing another example of the first support member shown in FIG. 2.
Figure 9C:
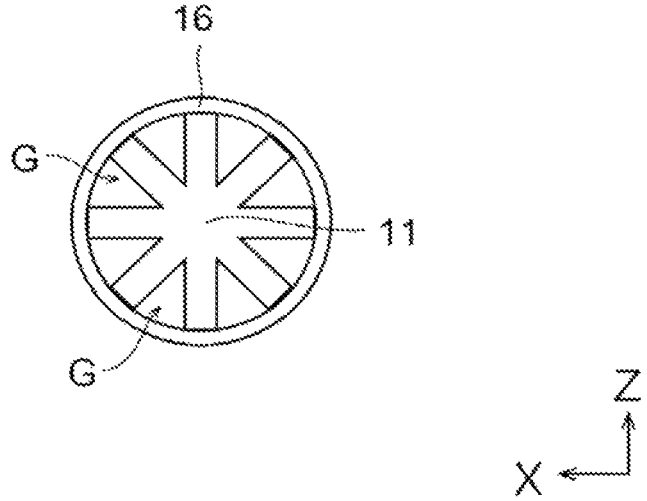
FIG. 9C is a plan view showing another example of the first support member shown in FIG. 2.

FIGS. 9A-9C show other examples of the planar shape of the first support member 11. The first support member 11 may have a planar shape of a star-shaped polygon other than a star-shaped decagon, for example, a planar shape of a pentagon (pentagram) (FIG. 9A). The first support member 11 may have a planar shape of a polygon such as a pentagon or a decagon. Alternatively, the first support member 11 may be formed of a rod-like member. For example, the first support member 11 may be formed by crossing a plurality of rod-like members (FIGS. 9B and 9C).

Although the plurality of the gaps G located between the first support member 11 and the packaging member 16 have been described in the above-described embodiment and modified examples, there may be a single gap G between the first support member 11 and the packaging member 16.

Figure 10:
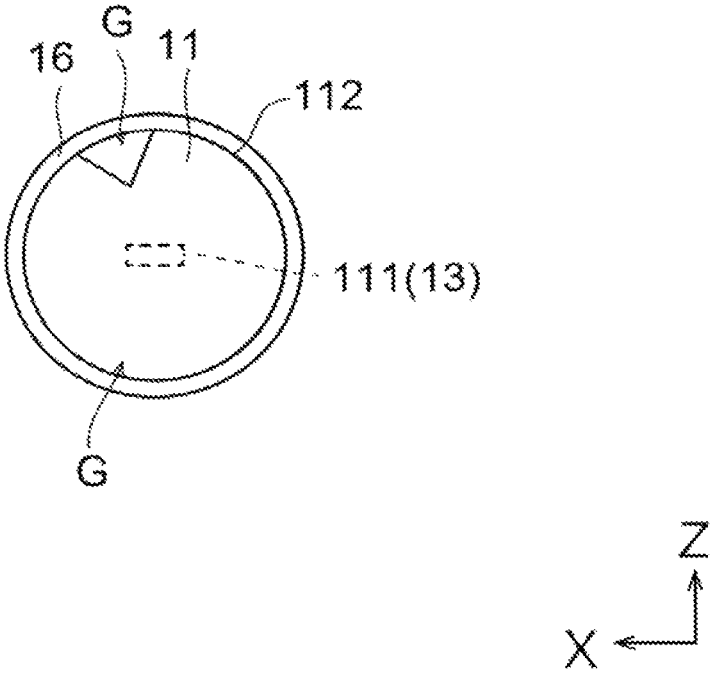
FIG. 10 is a plan view showing another example of a configuration of the one end portion of the smoking device cartridge shown in FIG. 2.

FIG. 10 shows an example of a configuration of one end face (XZ end face) of a smoking device cartridge having the single gap G. In this way, the number of the gaps G between the first support member 11 and the packaging member 16 may be one. This makes it easier, for example, for the first support member 11 and the packaging member 16 to adhere closely to each other, and makes it easier to hold the first support member 11 stably.

Although the description was given regarding examples in which both end faces (XZ cross-section) of the first support member 11 have the same shape in the extending direction (Y direction) of the aerosol-forming substrate 12 in the above-described embodiment and modified examples, both end faces of the first support member 11 may have different shapes.

Figure 11:
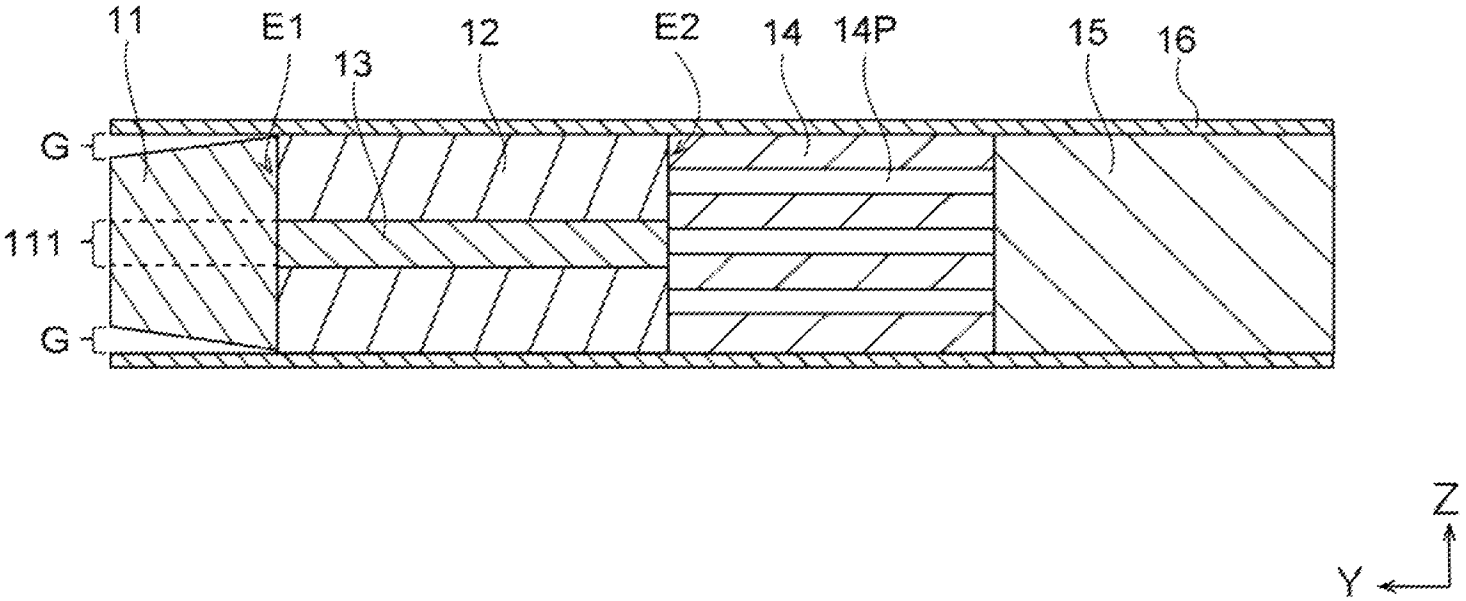
FIG. 11 is a cross-sectional view showing another example of the smoking device cartridge shown in FIGS. 1A and 1B.

FIG. 11 shows a configuration of a smoking device cartridge in which both end faces of the first support member 11 have different shapes. For example, in this smoking device cartridge, one end face of the first support member 11 has a planar shape of a star-shaped decagon (e.g., FIG. 2), and the other end face of the first support member 11 has a planar shape of a substantially circular shape (e.g., FIG. 10). The cross-sectional (XZ cross-sectional) shape of the first support member 11 gradually changes along the Y direction.

The cross-sectional shape of the first support member 11 may change stepwise at a predetermined position in the Y direction.

Although the above-described embodiment and modified examples illustrate examples in which the packaging member 16 covers all of the first support member 11, the aerosol-forming substrate 12, the second support member 14, and the mouthpiece 15 (e.g., FIG. 1), part of the first support member 11, the aerosol-forming substrate 12, the second support member 14, and the mouthpiece 15 may be exposed to the external environment from the packaging member 16.

Figure 12:
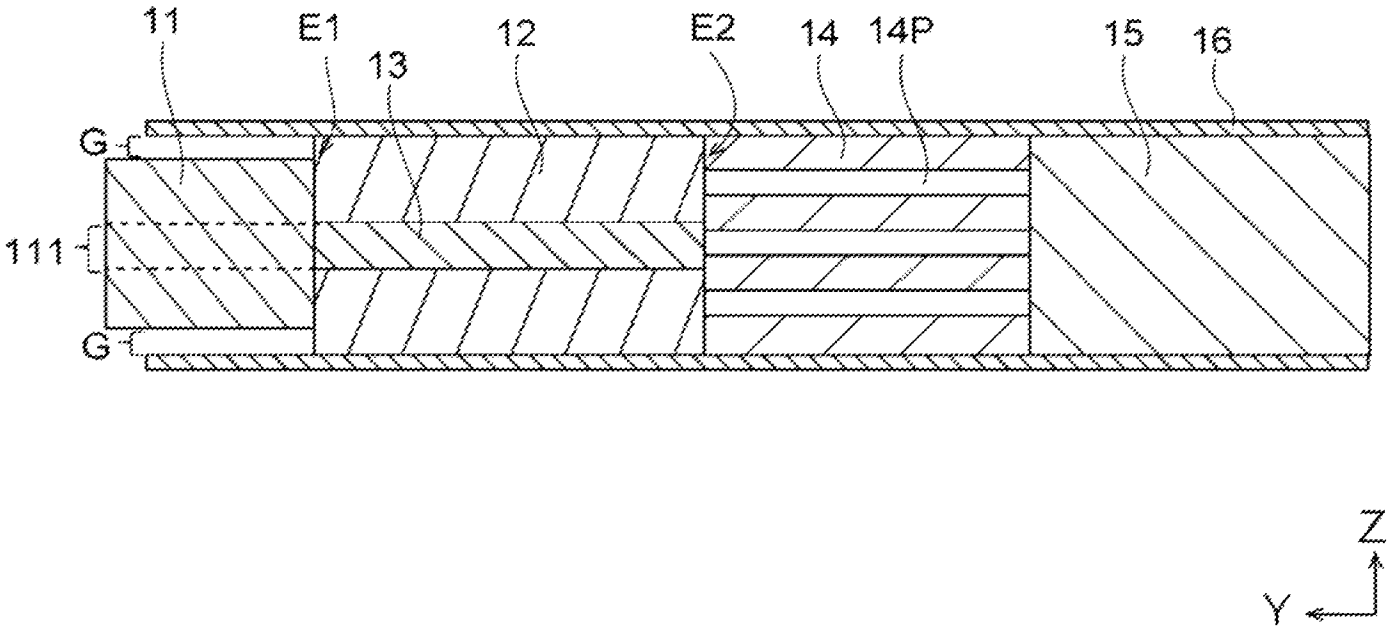
FIG. 12 is a cross-sectional view showing another example of the smoking device cartridge shown in FIGS. 1A and 1B.

FIG. 12 shows another example of a covering of the packaging member 16. For example, part of the first support member 11 may protrude from the packaging member 16 and be exposed to the external environment from the packaging member 16.

Although the susceptor 13 has been described being positioned on the central axis of the aerosol-forming substrate 12 in the above-described embodiment, the susceptor 13 may be positioned off the central axis of the aerosol-forming substrate 12. In other words, the facing portion 111 of the first support member 11 may be positioned off the central part of the XZ plane of the first support member 11.

Figure 13:
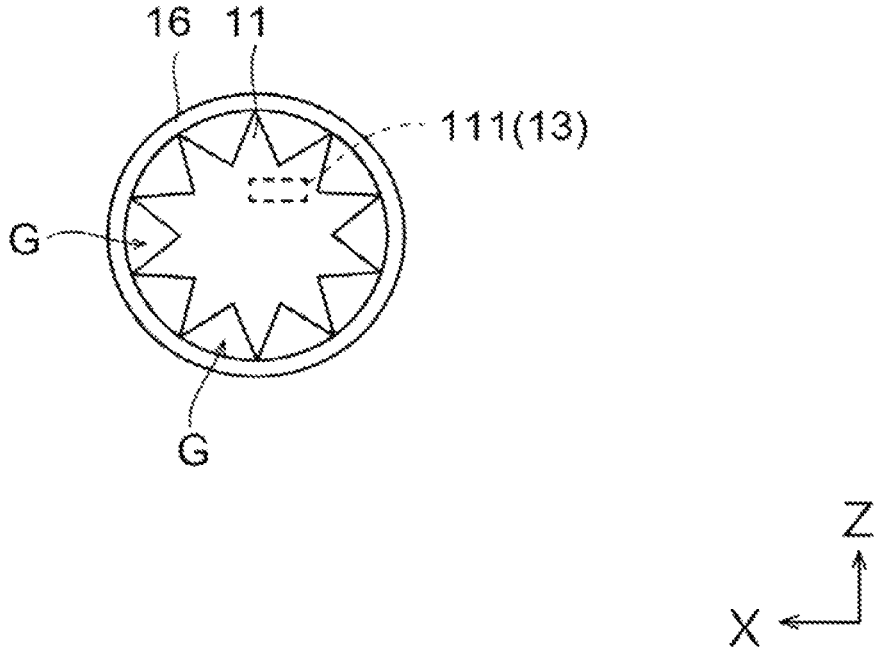
FIG. 13 is a plan view showing another example of a configuration of the one end portion of the smoking device cartridge shown in FIG. 2.

FIG. 13 shows another example of a covering of the packaging member 16. In this way, the susceptor 13 may be positioned off the central axis of the aerosol-forming substrate 12.

EXPLANATION OF REFERENCE LETTERS

10, 10A, 10B, 10C, 10D, 10E smoking device cartridge,
11 first support member,
111 facing portion,
112 contact portion,
12 aerosol-forming substrate,
13 susceptor,
14 second support member,
14P flow path,
15 mouthpiece,
16 packaging member,
16C incision,
16H hole portion,
17 membrane member,
20 smoking device,
21 insertion port,
22 coil
E1 one end
E2 the other end
G gap.

What is claimed is:

1. A smoking device cartridge to be mounted in an induction heating smoking device for use, the smoking device cartridge comprising:

an aerosol-forming substrate extending longitudinally in a Y-axis direction, the aerosol-forming substrate containing tobacco or non-tobacco plants as raw materials;

a susceptor extending longitudinally in the Y-axis direction, being provide inside the aerosol-forming substrate, the susceptor being configured to be inductively heatable;

a packaging member covering an outer circumference of the aerosol-forming substrate in an X-axis direction and a Z-axis direction; and a first support member being in contact with the packaging member, the first support member axially supporting one end of the aerosol-forming substrate, wherein the smoking device cartridge has a gap between the first support member and the packaging member, the first support member includes a facing portion facing the susceptor and a contact portion spaced apart from the facing portion, the contact portion being in contact with the packaging member, and the susceptor is fixed to the first support member.

2. The smoking device cartridge according to claim 1, wherein the first support member includes a plurality of the contact portions having adjacent contact portions arranged around a circumference of the first support member.

3. The smoking device cartridge according to claim 2, wherein the gap is located between the adjacent contact portions.

4. The smoking device cartridge according to claim 1, further comprising:

a membrane member located between the one end of the aerosol-forming substrate and the first support member, the membrane member covering the gap.

5. The smoking device cartridge according to claim 1, further comprising:

a mouthpiece axially aligned and in contact with the other end of the aerosol-forming substrate.

6. The smoking device cartridge according to claim 1, further comprising:

a second support member axially aligned and in contact with the other end of the aerosol-forming substrate in the extending direction; and a mouthpiece axially aligned and in contact with the second support member, the mouthpiece being connected to the other end of the aerosol-forming substrate via the second support member.

7. The smoking device cartridge according to claim 1, wherein the first support member is made of a non-porous material.

8. The smoking device cartridge according to claim 1, wherein the first support member is attachable to and detachable from the smoking device cartridge.

9. The smoking device cartridge according to claim 1, wherein the packaging member has an incision located at a position corresponding to the one end of the aerosol-forming substrate, or wherein the packaging member has an incision located at a position corresponding to the first support member.

10. A support member in combination with a smoking device cartridge to be mounted in an induction heating smoking device for use, the smoking device cartridge including:

an aerosol-forming substrate extending longitudinally in a Y-axis direction, the aerosol-forming substrate containing tobacco or non-tobacco plants as raw materials;

a susceptor extending longitudinally in the Y-axis direction, being provide inside the aerosol-forming substrate, the susceptor being configured to be inductively heatable; and a packaging member covering an outer circumference of the aerosol-forming substrate in an X-axis direction and a Z-axis direction, the support member axially supporting one end of the aerosol-forming substrate, the support member comprising:

a facing portion facing the susceptor; and a contact portion spaced apart from the facing portion, the contact portion being in contact with the packaging member, wherein a gap is located between the support member and the packaging member, and the susceptor is fixed to the first support member.

* * * * *